US011029113B2

(12) United States Patent
Hills

(10) Patent No.: US 11,029,113 B2
(45) Date of Patent: Jun. 8, 2021

(54) TRIGGER ACTUATOR

(71) Applicant: The United States Government as represented by The Department of Veterans Affairs, Washington, DC (US)

(72) Inventor: Seth R. Hills, Mechanicsville, VA (US)

(73) Assignee: The United States Government as represented by the Department of Veterans Affairs, Washington, DC (US)

( * ) Notice: Subject to any disclaimer, the term of this patent is extended or adjusted under 35 U.S.C. 154(b) by 0 days.

(21) Appl. No.: 16/788,429

(22) Filed: Feb. 12, 2020

(65) Prior Publication Data

US 2020/0256632 A1 Aug. 13, 2020

Related U.S. Application Data

(60) Provisional application No. 62/804,982, filed on Feb. 13, 2019.

(51) Int. Cl.
*F41A 19/08* (2006.01)
*F41A 19/55* (2006.01)

(52) U.S. Cl.
CPC ..... *F41A 19/08* (2013.01); *F41A 19/55* (2013.01)

(58) Field of Classification Search
CPC ..... F41A 19/06; F41A 19/08; F41A 19/55; F41A 19/58
See application file for complete search history.

(56) References Cited

U.S. PATENT DOCUMENTS

| | | | | |
|---|---|---|---|---|
| 348,868 | A * | 9/1886 | Straube | F41A 19/09 42/69.01 |
| 3,828,458 | A * | 8/1974 | Skone-Palmer | F41A 19/56 42/69.01 |
| 4,012,860 | A * | 3/1977 | Auger | F41A 23/16 42/94 |
| 4,718,187 | A * | 1/1988 | Blake | F41A 19/59 42/84 |
| 6,237,462 | B1 * | 5/2001 | Hawkes | F41A 23/12 89/37.05 |
| 6,715,395 | B1 * | 4/2004 | Heibel | F41A 19/58 180/287 |

(Continued)

*Primary Examiner* — Joshua E Freeman
(74) *Attorney, Agent, or Firm* — Ballard Spahr LLP

(57) ABSTRACT

A device for pulling the trigger of a firearm includes an actuator, a controller in signal communication with the actuator and a switch in communication with the controller. The actuator mounts on the firearm adjacent to the trigger. The actuator has a body movable into engagement with the trigger for pulling the trigger. The body is movable out of engagement with the trigger permitting the trigger to reset. The controller is adapted to transmit first and second commands to the actuator. The first command directs moving the body into engagement with the trigger, and the second command directs moving the body out of engagement with the trigger. The switch is adapted to transmit a first signal to the controller causing the controller to transmit the first command to the actuator, and a second signal to the controller for causing the controller to transmit the second command to the actuator.

18 Claims, 7 Drawing Sheets

(56) References Cited

U.S. PATENT DOCUMENTS

| | | | | |
|---|---|---|---|---|
| 8,234,968 | B2 * | 8/2012 | Hodge | F41A 27/06 89/41.05 |
| 8,397,621 | B2 * | 3/2013 | Hodge | F41A 27/06 89/41.05 |
| 9,863,731 | B1 * | 1/2018 | Aiderman | F41A 17/54 |
| 2006/0032487 | A1 * | 2/2006 | Tippmann, Sr. | F41B 11/723 124/74 |
| 2007/0204745 | A1 * | 9/2007 | Son | F41A 23/24 89/27.3 |
| 2008/0115660 | A1 * | 5/2008 | Hensel | F41A 19/08 89/136 |
| 2008/0121097 | A1 * | 5/2008 | Rudakevych | F41A 19/58 89/28.05 |
| 2009/0158922 | A1 * | 6/2009 | Werner | F41A 19/59 89/136 |
| 2010/0324859 | A1 * | 12/2010 | McNelis | F41A 19/01 702/150 |
| 2011/0154979 | A1 * | 6/2011 | Joel | F41A 19/12 89/27.11 |
| 2013/0205638 | A1 * | 8/2013 | Herring | F41A 31/02 42/90 |
| 2016/0047617 | A1 * | 2/2016 | DeGidio | F41A 19/08 42/69.01 |
| 2019/0025000 | A1 * | 1/2019 | Bascom | F41A 17/56 |
| 2019/0145738 | A1 * | 5/2019 | Chae | F41A 23/34 89/41.05 |
| 2019/0186856 | A1 * | 6/2019 | Bell | F41A 19/08 |
| 2019/0186857 | A1 * | 6/2019 | Galie | F41A 19/10 |

* cited by examiner

TRIGGER ACTUATOR

CROSS REFERENCE TO RELATED APPLICATIONS

This application is based upon and claims the benefit of priority to U.S. Provisional Application No. 62/804,982, filed Feb. 13, 2019, and hereby incorporated by reference in its entirety.

FIELD OF THE INVENTION

This invention relates to devices and methods for remotely pulling the trigger of a firearm.

BACKGROUND

It is a challenge for individuals with paralysis or limited upper extremity control to enjoy shooting sports. Accurate shooting requires a combination of gross and fine motor skills to acquire a target within the sights of a firearm, take careful aim and then squeeze the trigger without adversely affecting the aim point. Advantage may be had by individuals lacking the fine manual motor skills necessary for a controlled pull of the trigger by employing a remote trigger pulling mechanism which relies on machine actuation of the trigger using other muscle groups, such as the diaphragm, to control the machine actuation.

SUMMARY

The invention concerns a device for pulling a trigger of the firearm. In an example embodiment, the device comprises an actuator, a controller, and a switch. The actuator is mountable on the firearm adjacent to the trigger. The actuator has a body movable into engagement with the trigger for pulling the trigger. The body is moveable out of engagement with the trigger to permit the trigger to reset. The controller is in communication with the actuator. The controller is adapted to transmit a first command to the actuator for moving the body into engagement with the trigger for pulling the trigger, and a second command to the actuator for moving the body out of engagement with the trigger. The switch is in communication with the controller. The switch is adapted to transmit a first signal to the controller for causing the controller to transmit the first command to the actuator and a second signal to the controller for causing the controller to transmit the second command to the actuator.

In an example, the actuator comprises a servomotor and an arm. The servomotor has a rotatable shaft oriented transversely to a line of motion of the trigger. The arm is mounted on the shaft and extending transversely thereto. The arm has a free end engageable with the trigger upon rotation of the shaft.

As an example, the controller comprises a microprocessor. In an example, the switch comprises a pressure sensitive switch. In a particular example, the switch comprises a momentary switch. In another particular example, the switch comprises a push to close type switch.

In an example, the device further comprises a conduit in fluid communication with the pressure sensitive switch. The conduit is for conveying a change in gas pressure to the pressure sensitive switch.

In an example, the controller is adapted to transmit a third command to the actuator for moving the body into engagement with the trigger in preparation for pulling the trigger.

The invention also concerns a method for remotely pulling a trigger of a firearm using an actuator controlled by a controller. In an example embodiment, the method comprises:

- starting with the actuator in a reset position wherein the actuator does not engage the trigger;
- transmitting a first signal to the controller for moving the actuator into a first position into engagement with the trigger, the controller thereby moving the actuator into the first position in response to the first signal;
- transmitting a second signal to the controller for moving the actuator into a second position pulling the trigger;
- measuring a time period between transmitting the first signal and the second signal;
- if the time period is less than a threshold value, then the controller moves the actuator into the second position thereby pulling the trigger and then moves the actuator into the reset position in response to the second signal;
- if the time period is greater than the threshold value then the controller moves the actuator into the reset position in response to the second signal.

An example of the method may include steps wherein the first signal is transmitted to the controller by closing a switch. As an example, the method may include the step wherein the second signal is transmitted to the controller by closing the switch a second time. An example of the method may include steps wherein the switch is closed in response to changing a gas pressure.

The invention further encompasses a firearm. In an example embodiment the firearm comprises a trigger, an actuator, a controller, and a switch. The actuator is mountable on the firearm adjacent to the trigger. The actuator has a body movable into engagement with the trigger for pulling the trigger. The body is moveable out of engagement with the trigger to permit the trigger to reset. The controller is in communication with the actuator. The controller is adapted to transmit a first command to the actuator for moving the body into engagement with the trigger for pulling the trigger, and a second command to the actuator for moving the body out of engagement with the trigger. The switch is in communication with the controller. The switch is adapted to transmit a first signal to the controller for causing the controller to transmit the first command to the actuator, and a second signal to the controller for causing the controller to transmit the second command to the actuator.

As an example, the actuator comprises a servomotor, an arm. The servomotor has a rotatable shaft oriented transversely to a line of motion of the trigger. The arm is mounted on the shaft and extends transversely thereto. The arm has a free end engageable with the trigger upon rotation of the shaft.

As an example, the controller comprises a microprocessor. In an example, the switch comprises a pressure sensitive switch. In a particular example, the switch comprises a momentary switch. In another particular example, the switch comprises a push to close type switch.

In an example, the device further comprises a conduit in fluid communication with the pressure sensitive switch. The conduit is for conveying a change in gas pressure to the pressure sensitive switch.

In an example, the controller is adapted to transmit a third command to the actuator for moving the body into engagement with the trigger in preparation for pulling the trigger.

DETAILED DESCRIPTION

Figure 1:
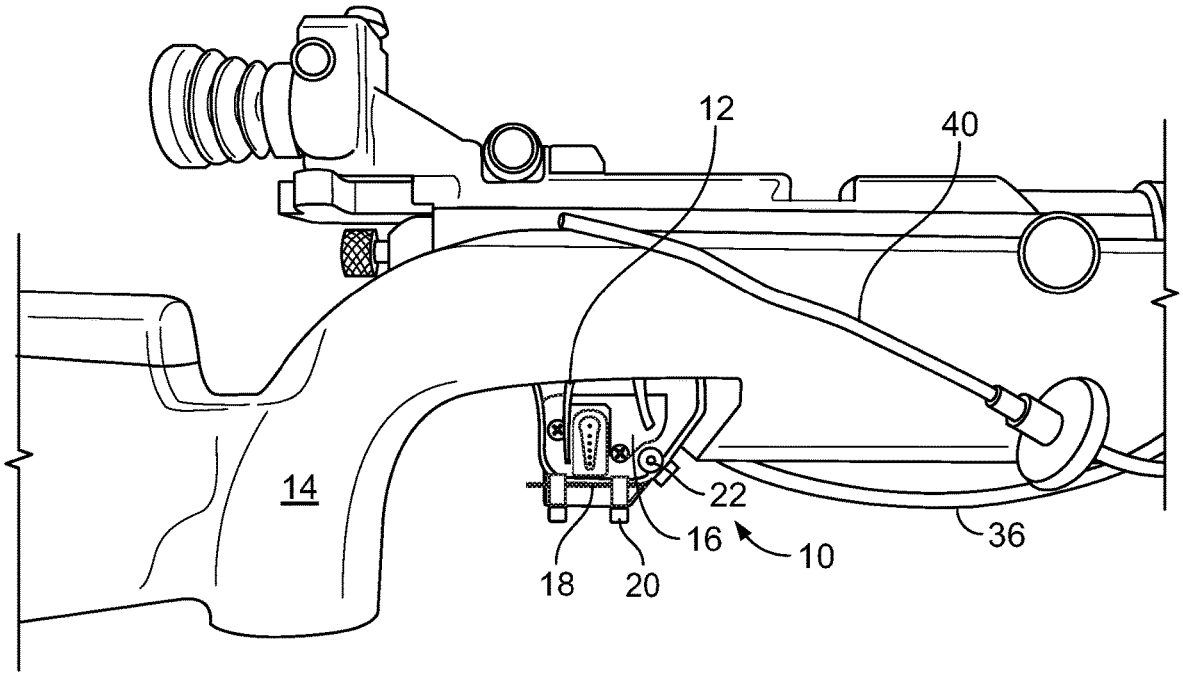
FIG. 1 is a right side view of a firearm having an example device for remotely pulling the trigger according to the invention.
Figure 2:
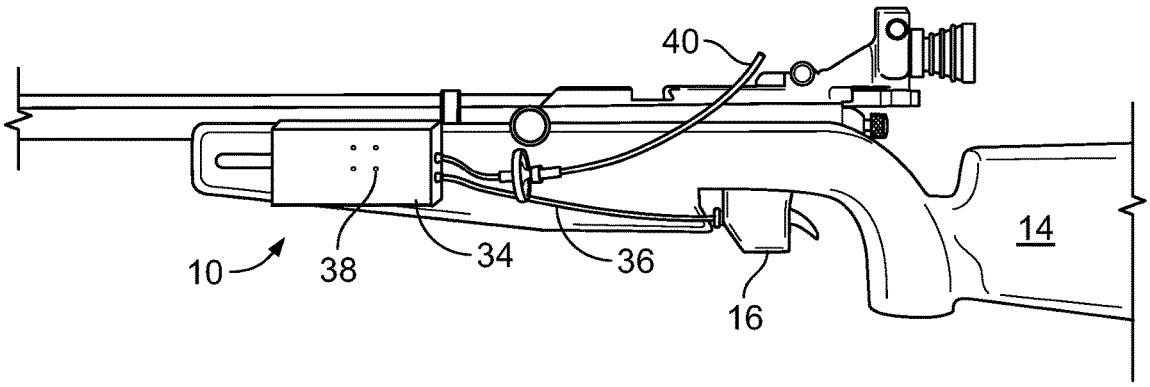
FIG. 2 is a left side view of the firearm and device shown in FIG. 1.
Figure 3:
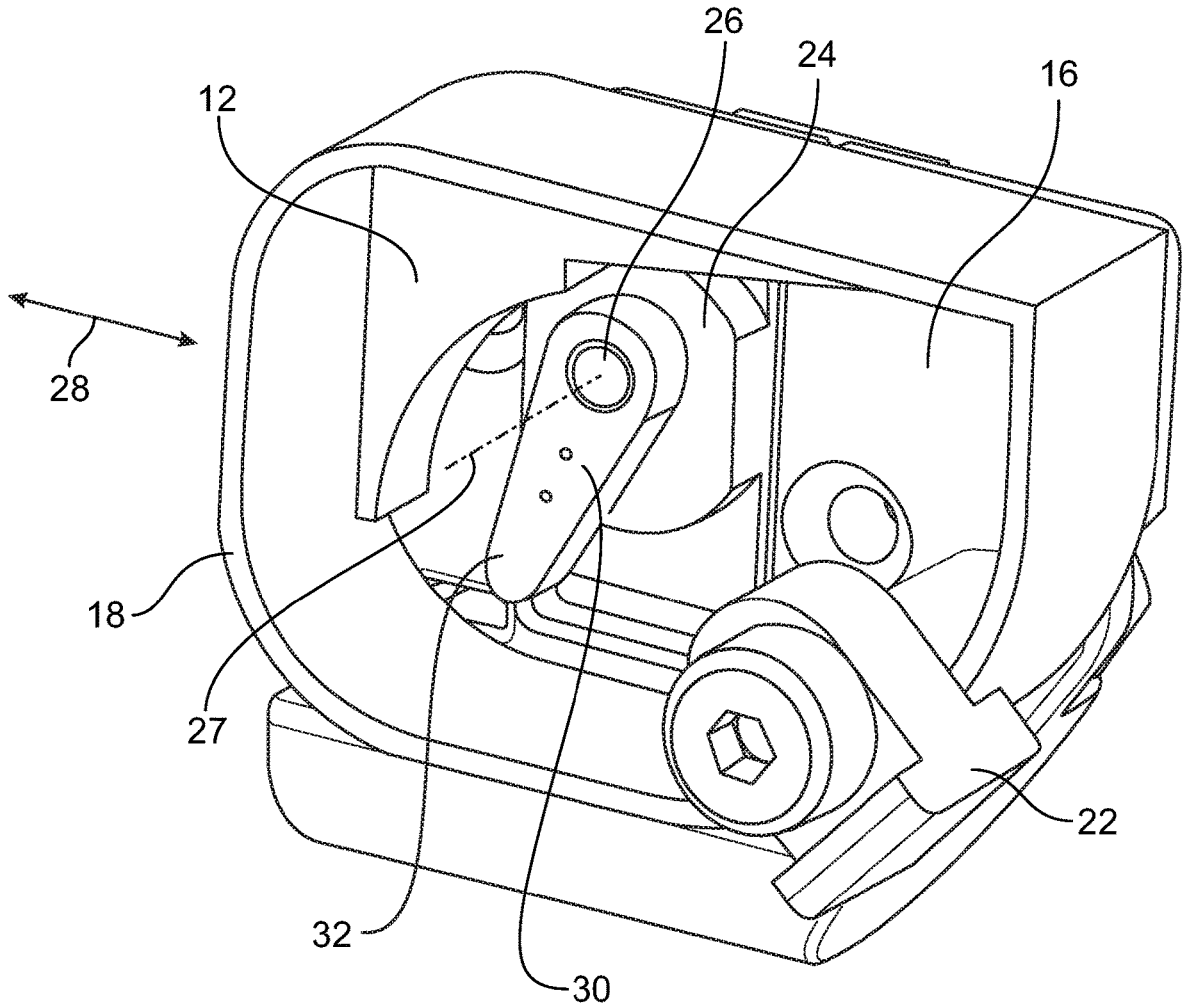
FIG. 3 is an isometric view of an example actuator used in the device shown in FIG. 1.

FIGS. 1 and 2 show a device 10 for pulling a trigger 12 of a firearm 14, in this example an air rifle. Device 10 comprises an actuator 16, shown in FIG. 1 mounted on a trigger guard 18 adjacent to the trigger 12. In the example embodiment shown the mounting of the actuator is effected using pull ties 20 and a screw clamp 22. FIG. 3 shows the actuator 16 in detail, which, in this example comprises a servo motor 24 having a rotatable shaft 26 with its axis of rotation 27 oriented transversely to a line of motion 28 of trigger 12. A body, in this example comprising an arm 30 is mounted on and extends transversely to the shaft 26. The arm 30 has a free end 32 which is engageable with the trigger 12 upon rotation of the shaft 26.

Device 10 further comprises a controller 34, shown in FIG. 2. In this example embodiment, the controller 34 is mounted on the fore end of the firearm and comprises a microprocessor, for example a commercially available programmable logic controller such as the Arduino Nano made by Arduino of Ivera, Italy. Controller 34 is electrically powered by an internal battery for example, and is in communication with the actuator 16 (also electrically powered) via an electrically conducting cable 36 over which the controller transmits commands to the actuator 16 which control rotation of shaft 26. Example commands include, a first command for moving arm 30 into engagement with the trigger 12 for pulling the trigger, a second command for moving the arm out of engagement with the trigger to permit the trigger to reset, as well as a third command to "stage" the arm 30 by moving it into engagement with the trigger 12 so that it is ready to move further into engagement and pull the trigger. These commands are described in detail below.

Device 10 also includes a switch 38 in communication with the controller. Switch 38 comprises the user interface to the controller and is adapted to transmit a first signal to the controller for causing the controller to transmit the first command to the actuator, and transmit a second signal to the controller to transmit the second command to the actuator as described below. Although any adaptive switch can be plugged into the controller, this example embodiment uses an integrated pressure sensitive switch 38 which can be opened and closed by a change in gas pressure. A conduit 40 is in fluid communication with the switch 38 and is used to convey a change in gas pressure to the switch. The sensitivity of the switch 38 is such that a user can trip the switch by orally drawing on the conduit to create a drop in pressure or blowing into the conduit to create an increase in pressure on the switch. It is advantageous for the switch to comprise a momentary push to close type switch for reliable transmission of signals to the controller 34.

Figure 4:
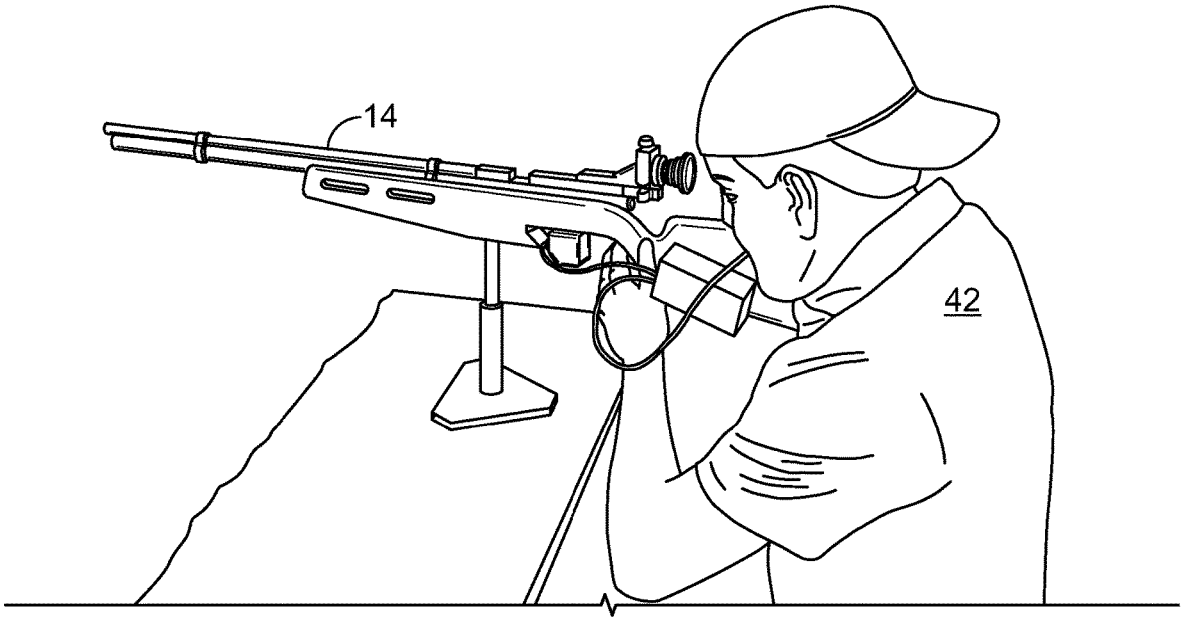
FIG. 4 shows a shooter using the device shown in FIG. 1.
Figure 5:
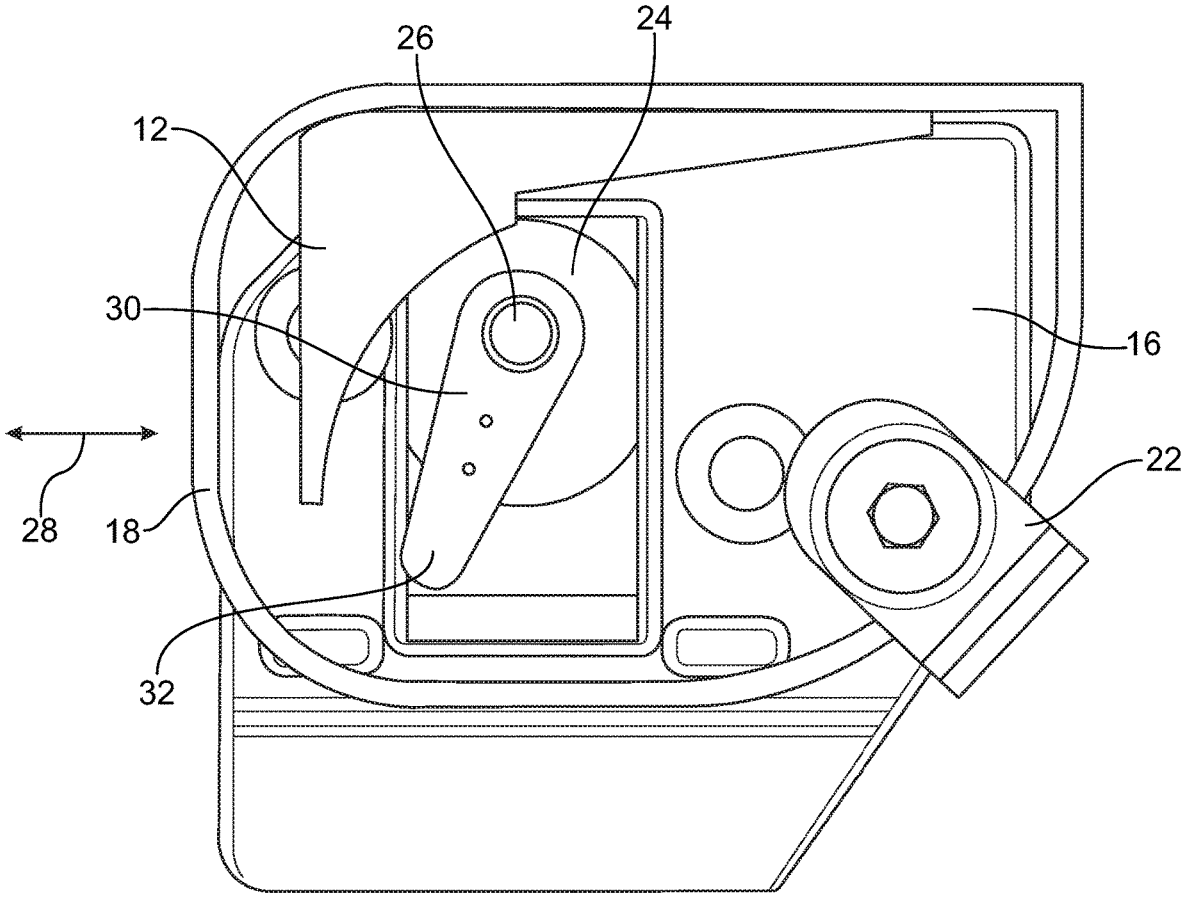
FIGS. 5-7 show steps in the operation of the actuator shown in FIG. 3.
Figure 6:
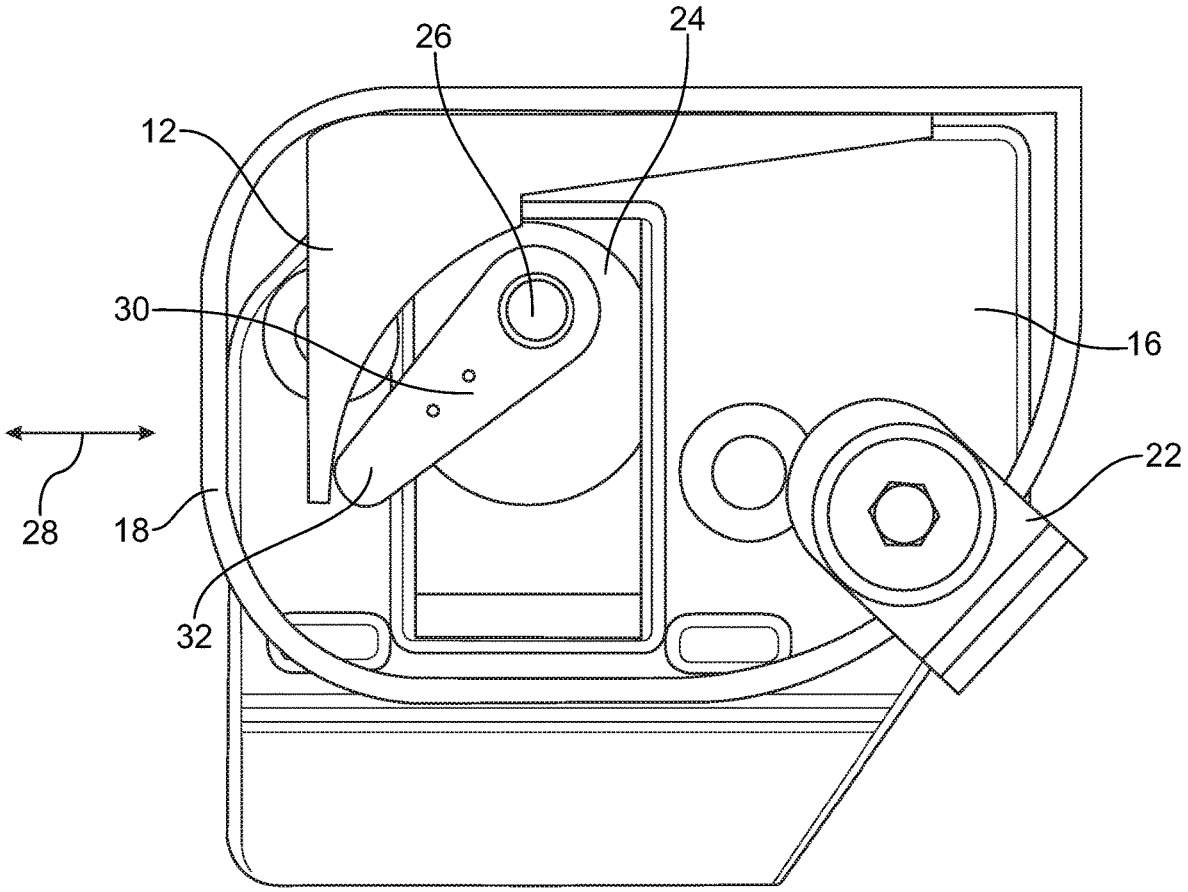
Figure 7:
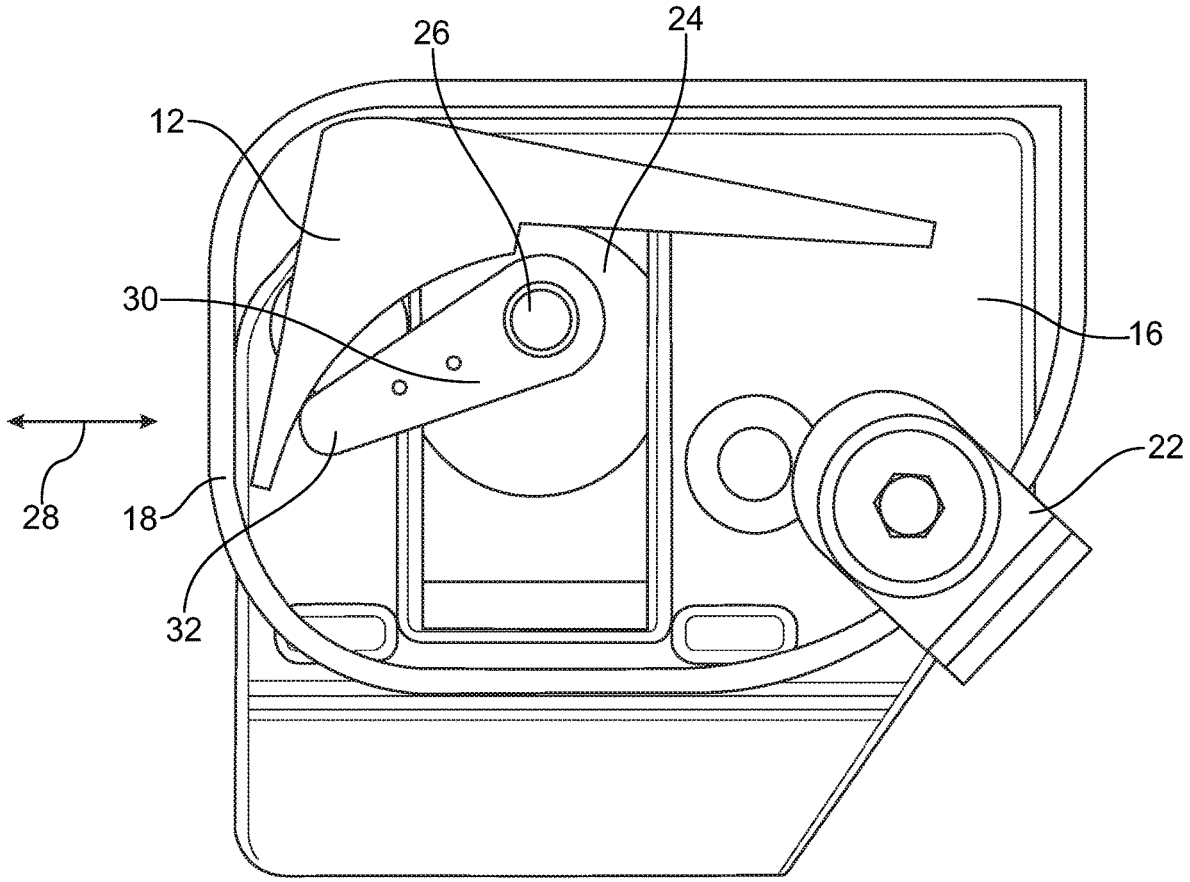
Figure 8:
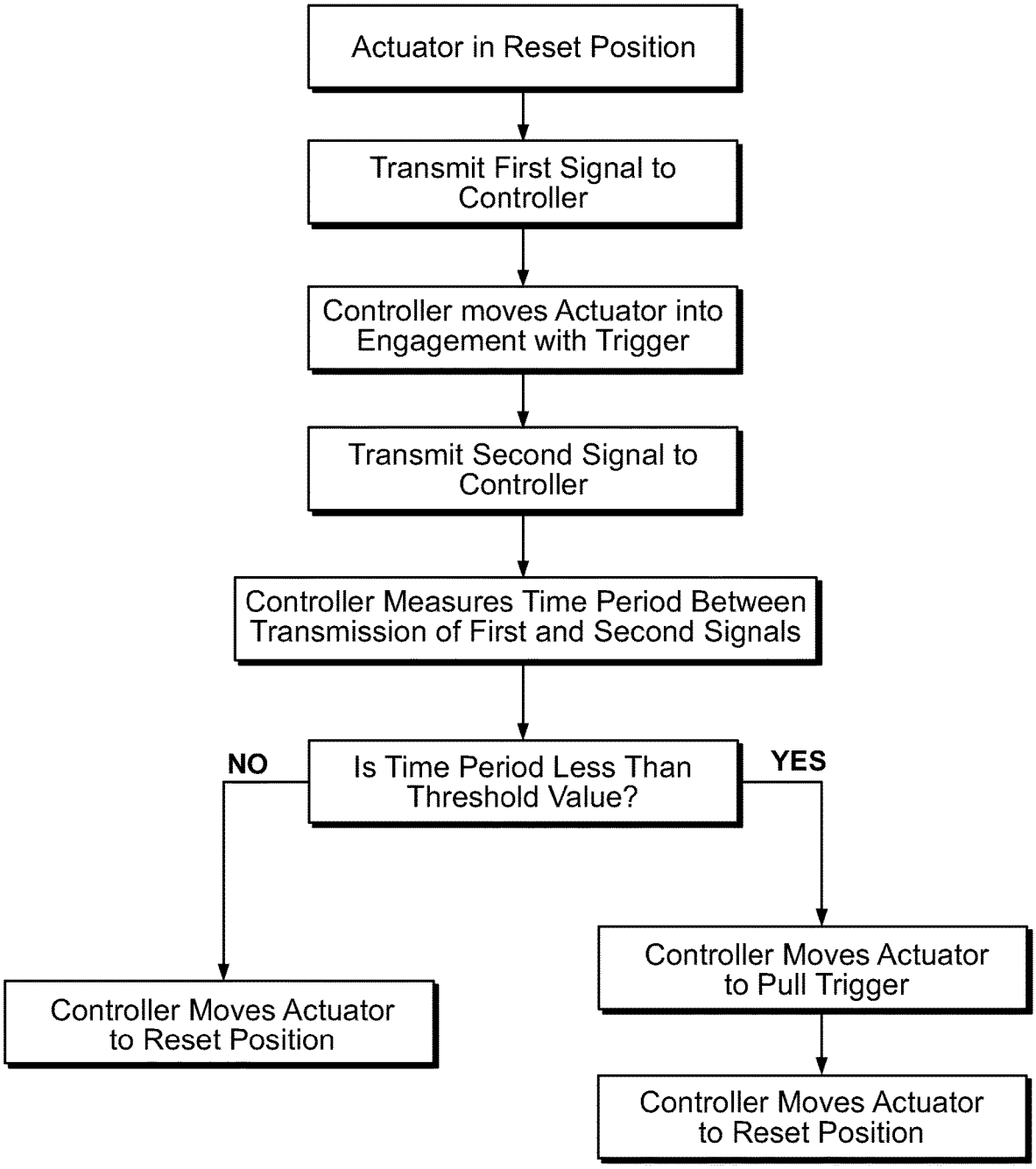
FIG. 8 is a flow chart illustrating an example method of remotely pulling a trigger of a firearm according to the invention.

FIGS. 4-7 and the flow chart of FIG. 8 illustrate an example method for remotely pulling the trigger 12 of the firearm 14. As shown in FIG. 4, a shooter 42 places the end of conduit 40 in his mouth as one would a drinking straw. (In this example the controller is mounted on the shoulder stock of the firearm.) The shooter then aims the firearm 14 to acquire the target. FIG. 5 shows the actuator 16, which is in the "reset" position during target acquisition, with the arm 30 not yet engaged with the trigger 12. The shooter 42 then transmits a first signal to the controller by changing the pressure within conduit 40. In this example the shooter blows into the conduit 40, which closes the pressure sensitive switch 38, causing the controller 34 to command the servo motor 24 to rotate the shaft 26 into a first position, shown in FIG. 6, with the free end 32 of arm 30 engaged with the trigger 12. Pressure is let off the switch 38, allowing it to open. Once the shooter 42 has taken final aim he transmits a second signal to the controller 34 by again blowing into the conduit 40 and increasing the gas pressure therewithin to close the switch 38. In response the controller 34 measures the time period between transmission of the first and second signals. If the measured time period is less than a threshold value, in a practical example, three seconds, then the controller 34 commands the servo motor 24 to further rotate the shaft 26, which causes the arm 30 to pull the trigger 12 as shown in FIG. 7, thereby firing the firearm. The controller then commands the servo motor 24 to rotate the shaft 26 so that arm 30 moves back to the reset position shown in FIG. 5 to allow trigger 12 to reset. However, if the measured time period is greater than the threshold value the controller 34 commands the servo motor 24 to rotate the shaft 26 so that the arm 30 moves back to the reset position shown in FIG. 5 without pulling the trigger 12.

Accuracy is improved by first staging the arm 30 into engagement with the trigger 12, and then, upon a second command, pulling the trigger to fire the firearm. This two-step process allows the shooter to first acquire the target, then position the arm 30 so that it engages the trigger, and then take final steady aim and pull the trigger with an acceptable amount of lag time between when the second command is given and when the trigger is pulled. Pulling the trigger directly from the reset position takes too long, and it is difficult to hold the aim point during this time period. The two-step process also provides greater safety, as the arm 30 only remains in contact with the trigger 12 for a short period of time and returns to the reset position from which the potential for an accidental discharge is mitigated.

What is claimed is:

1. A device for pulling a trigger of a firearm, said device comprising:

an actuator mountable on said firearm adjacent to said trigger, said actuator having a body movable into engagement with said trigger for pulling said trigger, said body being moveable out of engagement with said trigger to permit said trigger to reset;

a controller in communication with said actuator, said controller operating to transmit a first command to said actuator for moving said body into engagement with said trigger for pulling said trigger, and a second command to said actuator for moving said body out of engagement with said trigger, and a third command to said actuator for moving said body into engagement with said trigger in preparation for pulling said trigger; and a switch in communication with said controller, said switch cooperating with said controller to transmit:

a first signal to said controller for causing said controller to transmit said first command to said actuator; and a second signal to said controller for causing said controller to transmit said second command to said actuator.

2. The device according to claim 1, wherein said actuator comprises:

a servomotor having a rotatable shaft oriented transversely to a line of motion of said trigger;

an arm mounted on said shaft and extending transversely thereto, said arm having a free end engageable with said trigger upon rotation of said shaft.

3. The device according to claim 1, wherein said controller comprises a microprocessor.

4. The device according to claim 1, wherein said switch comprises a pressure sensitive switch.

5. The device according to claim 4, wherein said switch comprises a momentary switch.

6. The device according to claim 5, wherein said switch comprises a push to close type switch.

7. The device according to claim 4, further comprising a conduit in fluid communication with said pressure sensitive switch, said conduit for conveying a change in gas pressure to said pressure sensitive switch.

8. A method for remotely pulling a trigger of a firearm using an actuator controlled by a controller, said method comprising:

starting with said actuator in a reset position wherein said actuator does not engage said trigger;

transmitting a first signal to said controller for moving said actuator into a first position into engagement with said trigger, said controller thereby moving said actuator into said first position in response to said first signal;

transmitting a second signal to said controller for moving said actuator into a second position pulling said trigger;

measuring a time period between transmitting said first signal and said second signal;

if said time period is less than a threshold value, then said controller moving said actuator into said second position thereby pulling said trigger and then moving said actuator into said reset position in response to said second signal;

if said time period is greater than said threshold value then said controller moving said actuator into said reset position in response to said second signal.

9. The method according to claim 8, wherein said first signal is transmitted to said controller by closing a switch.

10. The method according to claim 9, wherein said second signal is transmitted to said controller by closing said switch a second time.

11. The method according to claim 10, wherein said switch is closed in response to changing a gas pressure.

12. A firearm, comprising:

a trigger;

an actuator mountable on said firearm adjacent to said trigger, said actuator having a body movable into engagement with said trigger for pulling said trigger, said body being moveable out of engagement with said trigger to permit said trigger to reset;

a controller in communication with said actuator, said controller operating to transmit a first command to said actuator for moving said body into engagement with said trigger for pulling said trigger, and a second command to said actuator for moving said body out of engagement with said trigger, and a third command to said actuator for moving said body into engagement with said trigger in preparation for pulling said trigger; and a switch in communication with said controller, said switch cooperating with said controller to transmit:

a first signal to said controller for causing said controller to transmit said first command to said actuator; and a second signal to said controller for causing said controller to transmit said second command to said actuator.

13. The firearm according to claim 12, wherein said actuator comprises:

a servomotor having a rotatable shaft oriented transversely to a line of motion of said trigger;

an arm mounted on said shaft and extending transversely thereto, said arm having a free end engageable with said trigger upon rotation of said shaft.

14. The firearm according to claim 12, wherein said controller comprises a microprocessor.

15. The firearm according to claim 12, wherein said switch comprises a pressure sensitive switch.

16. The firearm according to claim 15, wherein said switch comprises a momentary switch.

17. The firearm according to claim 16, wherein said switch comprises a push to close type switch.

18. The firearm according to claim 15, further comprising a conduit in fluid communication with said pressure sensitive switch, said conduit for conveying a change in gas pressure to said pressure sensitive switch.

* * * * *